US010066484B2

(12) United States Patent
Kato et al.

(10) Patent No.: US 10,066,484 B2
(45) Date of Patent: Sep. 4, 2018

(54) FLUID PRESSURE ROTATING MACHINE

(71) Applicant: KAYABA INDUSTRY CO., LTD., Tokyo (JP)

(72) Inventors: Hiroki Kato, Tokyo (JP); Takeru Hosokawa, Kanagawa (JP)

(73) Assignee: KYB Corporation, Tokyo (JP)

( * ) Notice: Subject to any disclaimer, the term of this patent is extended or adjusted under 35 U.S.C. 154(b) by 573 days.

(21) Appl. No.: 14/431,375

(22) PCT Filed: Mar. 6, 2014

(86) PCT No.: PCT/JP2014/055874
§ 371 (c)(1),
(2) Date: Mar. 26, 2015

(87) PCT Pub. No.: WO2014/156548
PCT Pub. Date: Oct. 2, 2014

(65) Prior Publication Data

US 2015/0240637 A1 Aug. 27, 2015

(30) Foreign Application Priority Data

Mar. 29, 2013 (JP) ..... 2013-073461

(51) Int. Cl.

| | |
|---|---|
| ***F01B 3/00*** | (2006.01) |
| ***F04B 1/02*** | (2006.01) |
| ***F04B 1/20*** | (2006.01) |
| ***F03C 1/32*** | (2006.01) |
| ***F03C 1/06*** | (2006.01) |

(52) U.S. Cl.
CPC ..... *F01B 3/0073* (2013.01); *F01B 3/0035* (2013.01); *F01B 3/0052* (2013.01); *F03C 1/0652* (2013.01); *F03C 1/0668* (2013.01); *F04B 1/02* (2013.01); *F04B 1/2035* (2013.01); *F04B 1/2078* (2013.01)

(58) Field of Classification Search
CPC .... F01B 3/0052; F01B 3/0073; F01B 3/0035; F04B 1/02; F04B 1/2078; F04B 1/2035; F03C 1/0668; F03C 1/0652
See application file for complete search history.

(56) References Cited

U.S. PATENT DOCUMENTS

| | | | |
|---|---|---|---|
| 3,136,264 | A | 6/1964 | Wahlmark |
| 2003/0179964 | A1 | 9/2003 | Hinks |

(Continued)

FOREIGN PATENT DOCUMENTS

| | | | |
|---|---|---|---|
| DE | 1294203 | B | 4/1969 |
| DE | 3105392 | A1 | 9/1982 |
| DE | 3501731 | A1 | 7/1986 |

(Continued)

*Primary Examiner* — Michael Leslie
*Assistant Examiner* — Abiy Teka
(74) *Attorney, Agent, or Firm* — Rabin & Berdo, P.C.

(57) ABSTRACT

A piston motor includes a bush in the form of a curved plate held in sliding contact with a back surface of a tiltable swash plate, a supply/discharge passage formed on the casing including a swash plate port formed on the swash plate and open on the back surface of the swash plate and a bush port penetrating through the bush and provided from a piston to the swash plate, and an elastic ring interposed between the casing and the bush and surrounding an opening end of the bush port.

5 Claims, 4 Drawing Sheets

(56) References Cited

U.S. PATENT DOCUMENTS

| | | | |
|---|---|---|---|
| 2005/0095144 | A1 | 5/2005 | Shimizu |
| 2013/0327208 | A1 | 12/2013 | Ohno et al. |

FOREIGN PATENT DOCUMENTS

| | | | | |
|---|---|---|---|---|
| DE | 3800031 | A1 | | 7/1989 |
| DE | 3902907 | A1 | | 8/1990 |
| JP | 10-77956 | A | | 3/1998 |
| JP | 2002005006 | A | * | 1/2002 |
| JP | 2005-105900 | A | | 4/2005 |
| JP | 2008-057343 | A | | 3/2008 |
| JP | 2008-231923 | A | | 10/2008 |
| JP | 2008231923 | A | * | 10/2008 |
| JP | 2009-180119 | A | | 8/2009 |
| KR | 10-2013-0030761 | A | | 3/2013 |

* cited by examiner

FLUID PRESSURE ROTATING MACHINE

TECHNICAL FIELD

The prevent invention relates to a fluid pressure rotating machine such as a piston pump or a piston motor in which a piston reciprocates in a cylinder and working fluid is supplied to and discharged from the cylinder.

BACKGROUND ART

JP2008-231923A discloses an opposed swash plate type fluid pressure rotating machine provided with a cylinder block including a plurality of cylinders, first pistons and second pistons projecting from opposite ends of the cylinders and a first swash plate and a second swash plate with which projecting ends of the first and second pistons respectively slide in contact.

In the fluid pressure rotating machine, according to the rotation of the cylinder, the first pistons reciprocate in the cylinders, following the first swash plate, and the second pistons reciprocate in the cylinders, following the second swash plate, whereby working fluid is supplied to and discharged from volume chambers in the cylinders.

The first and second swash plates are respectively provided with semi-cylindrical tilt shaft parts (journal parts) to make a displacement volume per rotation of the cylinder block variable, and tilt bearings for slidably supporting the tilt shaft parts are respectively provided on a casing. A bush (half bearing) in the form of a curved plate is disposed in the tilt bearing. The tilt shaft parts of the swash plates slide in contact with the bushes.

A supply/discharge passage for supplying and discharging the working fluid to and from the volume chamber in each cylinder are provided from the tilt shaft part of the first swash plate to the tilt bearing of the casing.

SUMMARY OF INVENTION

However, since the supply/discharge passage of the opposed swash plate type fluid pressure rotating machine is provided through the bush of the tilt bearing, a part of the working fluid flowing in the supply/discharge passage may flow out into the casing via the bush when the tilt shaft part of the first swash plate moves in a direction away from the tilt bearing of the casing.

The present invention aims to ensure the sealability of a supply/discharge passage provided in a tilt bearing in a fluid pressure rotating machine.

According to one aspect of the present invention, a fluid pressure rotating machine in which a piston projecting from a cylinder of a rotary cylinder block reciprocates, following a swash plate housed in a casing is provided. The fluid pressure rotating machine includes a bush in the form of a curved plate held in sliding contact with a back surface of the tiltable swash plate, a supply/discharge passage including a swash plate port formed on the swash plate and open on the back surface of the swash plate and a bush port penetrating through the bush and provided from the piston to the swash plate, and an elastic ring interposed between the casing and the bush and surrounding an opening end of the bush port.

DESCRIPTION OF EMBODIMENT

A case where an opposed swash plate type fluid pressure rotating machine according to an embodiment of the present invention is applied to a hydrostatic transmission (HST) mounted as a continuously variable transmission in a working vehicle or the like is described with reference to the drawings.

Figure 1:
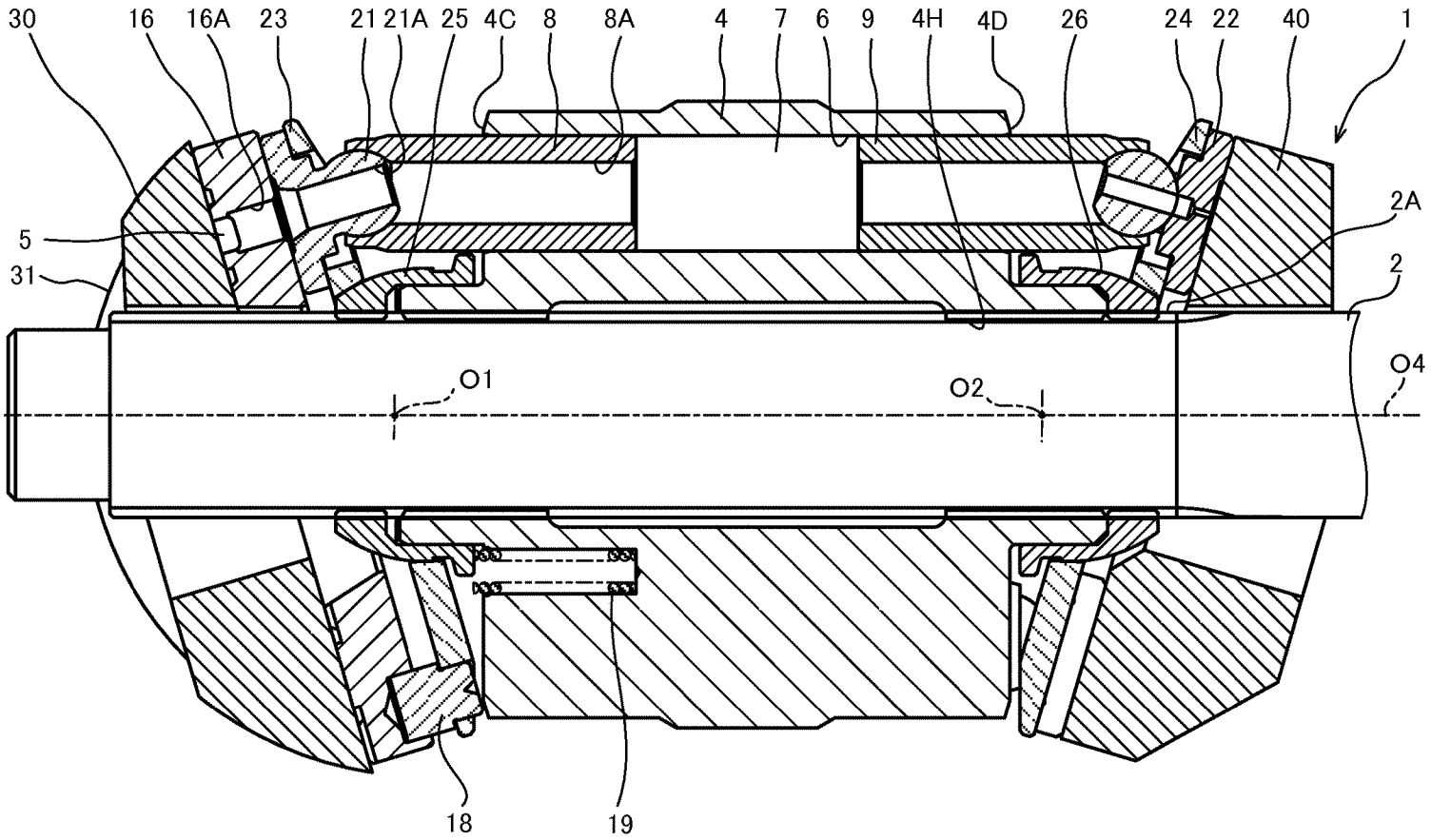
FIG. 1 is a sectional view of an opposed swash plate type fluid pressure rotating machine according to an embodiment of the present invention.

As shown in FIG. 1, an opposed swash plate type piston motor 1 includes a shaft 2 which rotates about an axis of rotation O4, a cylinder block 4 which is supported on the shaft 2 and a first swash plate 30 and a second swash plate 40 which are tilted while facing opposite ends of the cylinder block 4.

The cylinder block 4 is formed into a cylindrical tube including a hollow part. The shaft 2 is inserted into the cylinder block 4. The cylinder block 4 is formed by arranging a plurality of cylinders 6 side by side in a circumferential direction. The cylinders 6 are formed to extend in an axial direction and open on opposite end surfaces 4C, 4D of the cylinder block 4.

It should be noted that the "circumferential direction" means a direction of a circumference centered on the axis of rotation O4 of the cylinder block 4 and the "axial direction" means an extending direction of the axis of rotation O4.

A first piston 8 and a second piston 9 are respectively inserted into the cylinder 6 from opposite opening ends. The first and second pistons 8, 9 include tip parts projecting from the opening ends of the cylinder 6 and a first shoe 21 and a second shoe 22 are slidably coupled to the respective tip parts.

When the cylinder block 4 rotates, the first piston 8 reciprocates following the first swash plate 30 via the first shoe 21 and a port plate 16, and the second piston 9 reciprocates following the second swash plate 40 via the second shoe 22.

In the cylinder 6, a volume chamber 7 is defined between the first and second pistons 8, 9. The volume chamber 7 expands and contracts by the reciprocation of the first and second pistons 8, 9 in the cylinder 6, whereby hydraulic oil is supplied to and discharged from the volume chamber 7 through a supply/discharge passage 5 to be described later.

Although the piston motor 1 uses the hydraulic oil (oil) as the working fluid, water-soluble alternative liquid or the like may be, for example, used instead of the hydraulic oil.

Figure 2:
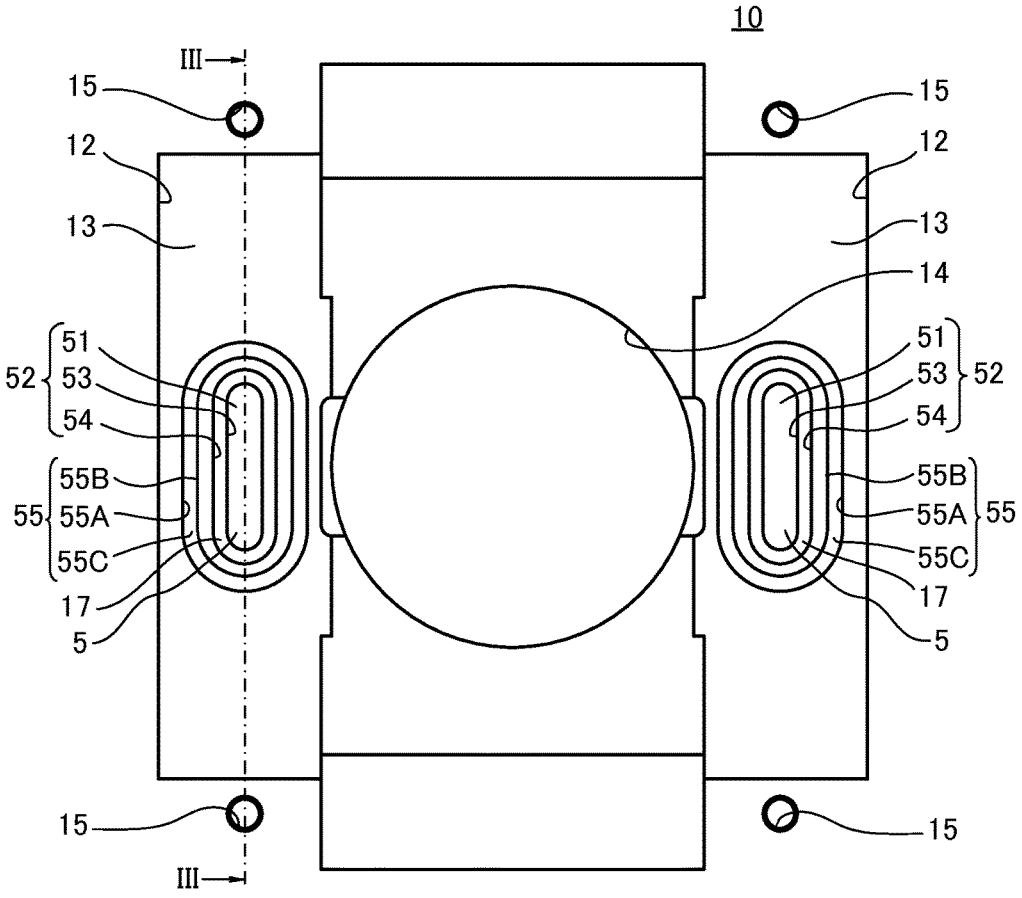
FIG. 2 is a bottom view of a casing.

Opposite end parts of the cylindrical shaft 2 are rotatably supported on a casing 10 (see FIG. 2) via bearings (not shown). The casing 10 includes a tubular case and a pair of covers for closing opposite opening ends of the case. The cylinder block 4 is housed in the case, and the first and second swash plates 30, 40 are housed in the respective covers. The casing 10 shown in FIG. 2 is a cover for housing the first swash plate 30.

A spline 2A is formed on the outer periphery of the shaft 2. A spline 4H is formed on the inner periphery of the cylinder block 4. By slidably fitting the spline 4H of the cylinder block 4 to the spline 2A of the shaft 2, the rotation of the cylinder block 4 relative to the shaft 2 is regulated and the cylinder block 4 can move in the axial direction relative to the shaft 2.

A first retainer plate 23 and a first retainer holder 25 are interposed side by side in the axial direction between the first swash plate 30 and the cylinder block 4.

The disk-shaped port plate 16 which rotates together with the cylinder block 4 is provided between the first shoe 21 and the first swash plate 30. The port plate 16 is coupled to the first retainer plate 23 via a plurality of pins 18.

A plurality of center springs 19 are interposed side by side in the circumferential direction between the first retainer holder 25 and the cylinder block 4. The cylinder block 4 is biased rightward in FIG. 1 by the center springs 19 and pressed against the second swash plate 40 via a second retainer holder 26, a second retainer plate 24 and the second shoe 22. As a result, the axial position of the cylinder block 4 relative to the second swash plate 40 is determined.

The first swash plate 30 is tiltably supported on the casing 10 (see FIG. 2) via a tilt supporting mechanism to be described later. The first swash plate 30 rotates about a tilt axis O1. The second swash plate 40 rotates about a tilt axis O2. The tilt axes O1, O2 are orthogonal to the axis of rotation O4 of the cylinder block 4.

The piston motor 1 includes driving mechanisms (not shown) for respectively tilting the first and second swash plates 30, 40. By respectively tilting the first and second swash plates 30, 40, reciprocating stroke lengths of the first and second pistons 8, 9 in the cylinders 6 change and the displacement volume per rotation of the cylinder block 4 changes. By changing the displacement volume, a rotation speed of the cylinder block 4 is adjusted to change a speed ratio of the hydrostatic transmission.

Figure 3:
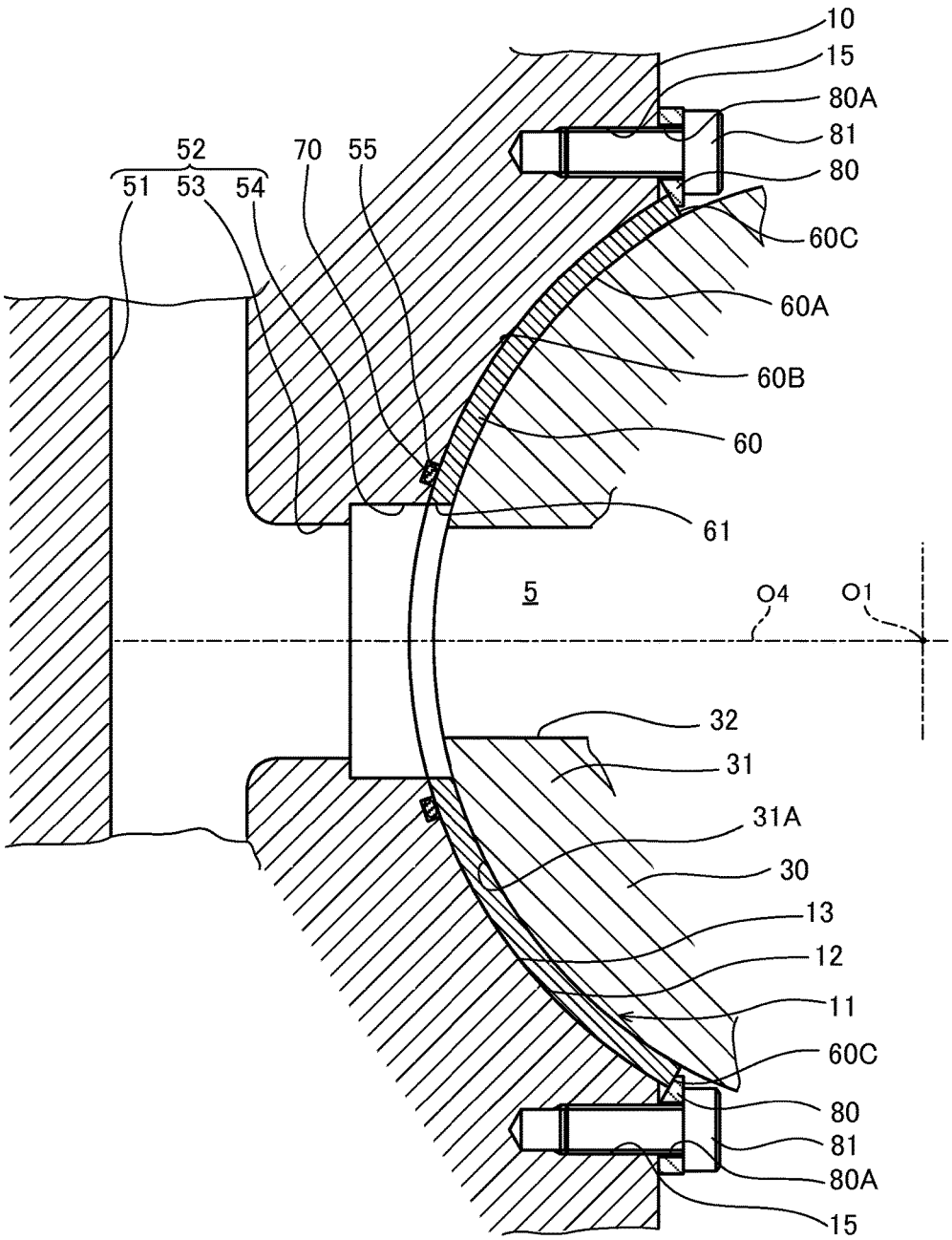
FIG. 3 is a sectional view along line III-III of FIG. 2.

FIG. 2 is a bottom view of the casing (cover) 10 for housing the first swash plate 30, and FIG. 3 is a sectional view along line III-III of FIG. 2.

As shown in FIG. 2, the casing 10 is formed with a through hole 14 through which the shaft 2 is passed, and a pair of bearing recesses 12 are formed at opposite sides of the through hole 14.

As shown in FIG. 3, the tilt supporting mechanism for the first swash plate 30 includes a pair of tilt shaft parts (journal parts) 31 provided on a rear surface side of the first swash plate 30 and a pair of tilt bearings 11 provided on the casing 10.

The tilt shaft part 31 is in the form of a semi-cylinder projecting from the rear surface side of the first swash plate 30 and includes a swash plate back surface 31A in the form of a cylinder surface and a swash plate port 32 penetrating through the first swash plate 30 and open on the swash plate back surface 31A.

The tilt bearing 11 includes the bearing recess 12 formed on the casing 10 and a bush (half bearing) 60 disposed in the bearing recess 12. The bottom surface of the bearing recess 12 constitutes a supporting surface 13 for supporting the bush 60.

The bush 60 is formed into a semi-circularly curved plate and includes a bearing surface 60A held in sliding contact with the swash plate back surface 31A and a back surface 60B held in contact with the supporting surface 13 of the casing 10.

The first swash plate 30 is supported tiltably about the axis O1 by the sliding contact of a pair of swash plate back surfaces 31A with the bearing surfaces 60A of the respective bushes 60.

The bush 60 is formed with a bush port 61 in the form of a long hole penetrating through a central part of the bush 60. The bush port 61 is connected to a casing port 52 formed on the casing 10 and communicates with a working hydraulic pressure source (not shown).

The casing port 52 includes a through hole 51 communicating with the working hydraulic pressure source, a back-side port part 53 orthogonally connected to the through hole 51 and an opening end-side port part 54 extending coaxially with the back-side port part 53 and open on the supporting surface 13.

A flow passage cross-sectional area of the opening end-side port part 54 is larger than that of the back-side port part 53. By enlarging the flow passage cross-sectional area of the opening end-side port part 54, the swash plate port 32 is constantly open to the opening end-side port part 54 regardless of a tilt angle of the first swash plate 30.

A pair of supply/discharge passages 5 are formed by a piston port 8A formed on the first piston 8, a shoe port 21A formed on the first shoe 21, a port 16A formed on the port plate 16, a pair of swash plate ports 32 formed on the first swash plate 30, the bush ports 61 and the casing ports 52.

Hydraulic oil supplied into the volume chamber 7 through one supply/discharge passage 5 reaches the volume chamber 7 from one casing port 52 through the bush port 61, one swash plate port 32, the port 16A, the shoe port 21A and the piston port 8A.

The hydraulic oil discharged from the volume chamber 7 through the other supply/discharge passage 5 reaches the other casing port 52 from the volume chamber 7 through the piston port 8A, the shoe port 21A, the port 16A, the other swash plate port 32 and the bush port 61.

The first and second pistons 8, 9 respectively push the first and second swash plates 30, 40 by the pressure of the hydraulic oil supplied to each volume chamber 7. At this time, the cylinder block 4 and the shaft 2 are driven to rotate by circumferential components of reaction forces received by the first and second pistons 8, 9 from the first and second swash plates 30, 40.

Next, a structure for sealing the supply/discharge passage 5 in the tilt bearing 11 is described.

Locking members (plates) 80 are provided at opposite sides of each bearing recess 12 on the casing 10. A pair of locking members 80 are engaged with both tips 60C of the bush 60 to prevent the both tips 60C of the bush 60 from projecting from the bearing recess 12.

The bush 60 is fastened to the casing 10 via bolts 81. A bolt hole 80A is formed to penetrate through the locking member 80. The casing 10 is formed with four screw holes 15. By inserting the bolts 81 into the bolt holes 80A and threadably engaging them with the screw holes 15, the locking members 80 are fixed while facing the opening end of the bearing recess 12.

The bush 60 is deflected by being pushed by the tilt shaft part 31 of the first swash plate 30 and the back surface 60B thereof comes into contact with the supporting surface 13 of the casing 10. When the tilt shaft part 31 of the first swash plate 30 moves in a direction away from the supporting surface 13 (rightward direction in FIGS. 1 and 3), the both tips 60C of the bush 60 come into contact with the locking members 80, thereby preventing the back surface 60B of the bush 60 from being largely separated from the supporting surface 13 of the casing 10.

As shown in FIG. 3, an annular elastic ring (O-ring) 70 is interposed between the bearing recess 12 and the bush 60 of the casing 10. The elastic ring 70 is arranged to surround the supply/discharge passage 5 to prevent the leakage of the hydraulic oil from the supply/discharge passage 5 into the casing 10.

An annular housing groove 55 is open on the supporting surface 13 to surround the casing port 52, and the elastic ring 70 is housed in the housing groove 55. The elastic ring 70 is arranged between the casing 10 and the bush 60 to surround a connected part of the casing port 52 and the bush port 61.

Figure 4:
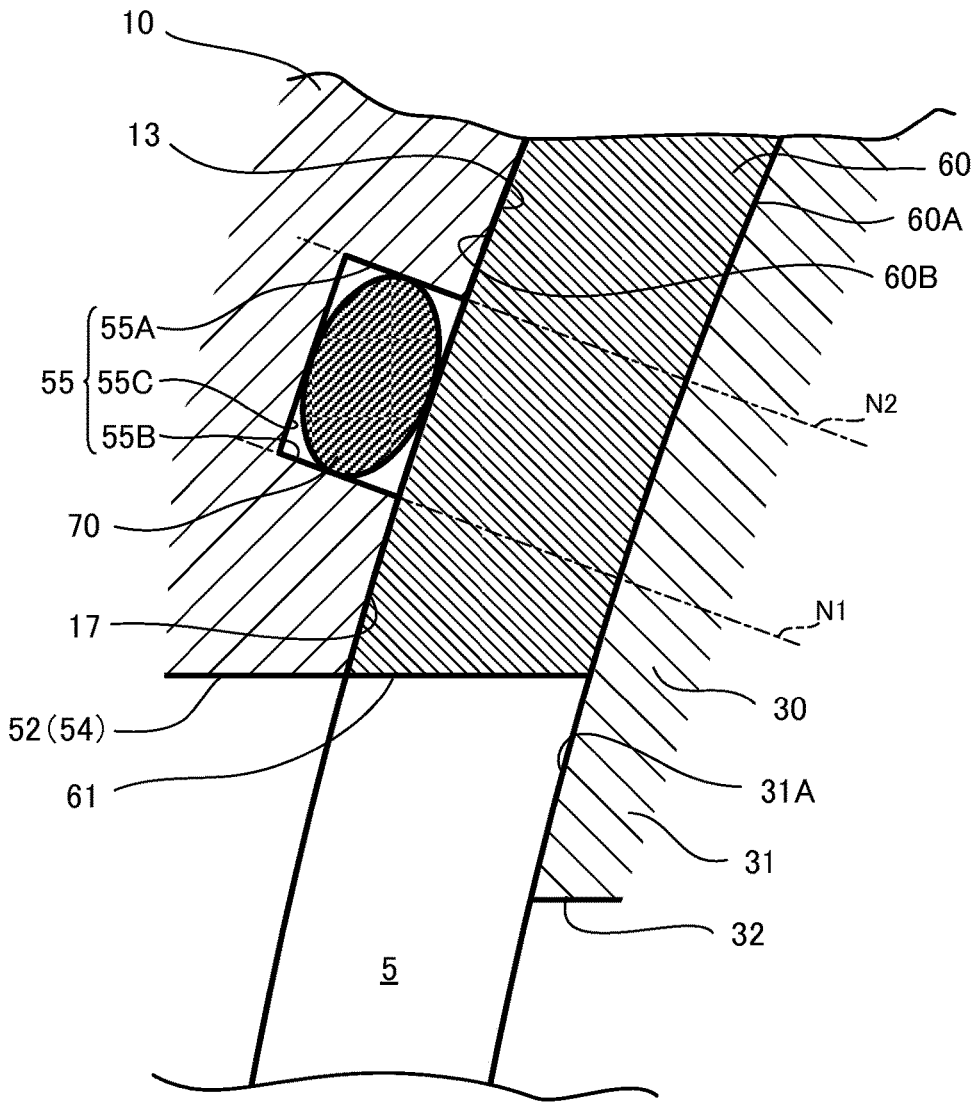
FIG. 4 is a sectional view enlargedly showing a part of FIG. 3.

FIG. 4 is a sectional view enlargedly showing a peripheral part of the housing groove 55 in FIG. 3. As shown in FIG. 4, the casing 10 is formed with an annular partition wall part 17 partitioning between the housing groove 55 and the supply/discharge passage 5. The partition wall part 17 is in the form of a rib projecting to surround the supply/discharge passage 5, the opening end-side port part 54 is defined by the inner peripheral surface of the partition wall part 17 and the housing groove 55 is defined by the outer peripheral surface thereof.

The housing groove 55 includes a groove inner surface 55A facing the outer periphery of the elastic ring 70, a groove inner surface 55B facing the inner periphery of the elastic ring 70 and a groove bottom surface 55C facing one end surface of the elastic ring 70.

The groove inner surfaces 55A, 55B extending on the inner and outer peripheries of the housing groove 55 are formed to extend along normals N1, N2 of the arcuate supporting surface 13. That is, the groove inner surfaces 55A, 55B extend in a normal direction with respect to the arcuate supporting surface 13.

The groove bottom surface 55C extending on a bottom part of the housing groove 55 is formed to extend in a tangential direction with respect to the supporting surface 13.

The elastic ring 70 is formed of an elastic resin material such as a rubber material and formed to have a circular or elliptical cross-sectional shape in a free state.

It should be noted that, without limitation to the configuration described above, a housing groove for housing the elastic ring 70 may be so formed on the bush 60 to be open on the back surface 60B of the bush 60.

Next, a function of sealing the supply/discharge passage 5 in the tilt bearing 11 is described.

The elastic ring 70 is elastically deformed to have a flat cross-sectional shape by being compressed between the housing groove 55 and the bush 60. The outer peripheral surface of the elastic ring 70 is pressed against the groove inner surfaces 55A, 55B and the groove bottom surface 55C of the housing groove 55 and the back surface 60B of the bush 60.

By elastically deforming the elastic ring 70 compressed by the bush 60 along the groove inner surfaces 55A, 55B, an elastic restoring force of the elastic ring 70 acts on the arcuate swash plate back surface 31A in the normal direction. By the elastic restoring force of the elastic ring 70, the bush 60 follows the swash plate back surface 31A.

The elastic ring 70 is elastically deformed and pressed against the groove bottom surface 55C of the housing groove 55 and the back surface 60B of the bush 60, whereby the connected part of the casing port 52 and the bush port 61 is sealed to prevent the leakage of the hydraulic oil into the casing 10.

Further, the first piston 8 presses the bush 60 against the supporting surface 13 via the first shoe 21, the port plate 16 and the first swash plate 30 by the working hydraulic pressure introduced to the volume chamber 7 and the first retainer holder 25 presses the bush 60 against the supporting surface 13 via the first shoe 21 and the port plate 16 by the center springs 19. On the other hand, the bush 60 is pressed against the swash plate back surface 31A by the working hydraulic pressure acting on the back surface 60B of the bush 60 facing the supply/discharge passage 5 surrounded by the elastic ring 70.

A pressure receiving area of the bush 60 facing the supply/discharge passage 5 surrounded by the elastic ring 70 is so set that a load obtained by the working hydraulic pressure of the supply/discharge passage pressing the bush 60 against the swash plate 31A is lower than a load obtained by the swash plate back surface 31A pressing the bush 60 against the supporting surface 13.

Since the load obtained by the working hydraulic pressure of the supply/discharge passage pressing the bush 60 against the swash plate 31A is lower than the load obtained by the swash plate back surface 31A pressing the bush 60 against the supporting surface 13 by means of the first piston 8 or the like, the separation of the back surface 60B of the bush 60 from the supporting surface 13 is suppressed and the leakage of the hydraulic oil into the casing 10 is prevented.

According to the above embodiment, the following functions and effects are achieved.

The elastic ring 70 is pressed against the back surface 60B of the bush 60 by the elastic restoring force of the elastic ring 70, and the elastic ring 70 follows the back surface 60B of the bush 60. As a result, the sealability of the supply/discharge passage 5 provided in the tilt bearing 11 is ensured and the leakage of the hydraulic oil from the tilt bearing 11 into the casing 10 is prevented.

Embodiments of the present invention were described above, but the above embodiments are merely examples of applications of the present invention, and the technical scope of the present invention is not limited to the specific constitutions of the above embodiments.

For example, although the present embodiment relates to the piston motor in which the hydraulic oil is supplied and discharged to rotate the cylinder block, it may relate to a piston pump in which a cylinder block is driven to rotate to supply and discharge hydraulic oil.

Furthermore, although the piston motor constitutes the hydrostatic transmission (HST) in the present embodiment, it may constitute another machine or facility.

Furthermore, although the present embodiment relates to the fluid pressure rotating machine of the opposed type in which the first and second swash plates are provided to face the opposite ends of the cylinder block, it may relate to a fluid pressure rotating machine in which one swash plate is provided to face one end of the cylinder block.

This application claims priority based on Japanese Patent Application No. 2013-73461 filed with the Japan Patent Office on Mar. 29, 2013, the entire contents of which are incorporated into this specification.

The invention claimed is:

1. A fluid pressure rotating machine in which a piston projecting from a cylinder of a rotary cylinder block reciprocates, following a tiltable swash plate housed in a casing, comprising:

a bush in the form of a curved plate held in sliding contact with a back surface of the tiltable swash plate;

a supply/discharge passage includes a swash plate port formed on the swash plate and open on the back surface of the swash plate, and a bush port penetrating through the bush, the supply/discharge passage being provided from the piston to the swash plate;

an elastic ring interposed between the casing and the bush and surrounding an opening end of the bush port; and a supporting surface formed on the casing for supporting the bush, wherein a pressure receiving area of the bush surrounded by the elastic ring and facing the supply/discharge passage is so set that a load obtained by a working fluid pressure of the supply/discharge passage pressing the bush against the back surface of the swash plate is lower than a load obtained by the back surface of the swash plate pressing the bush against the supporting surface.

2. The fluid pressure rotating machine according to claim 1, wherein:

the supply/discharge passage further includes a casing port formed in the casing and open on the supporting surface; and the elastic ring surrounds a connected part of the bush port and the casing port.

3. The fluid pressure rotating machine according to claim 2, further comprising a housing groove formed in the casing to surround the casing port and open on the supporting surface, wherein:

the elastic ring is housed in the housing groove.

4. The fluid pressure rotating machine according to claim 3, wherein:

a groove inner surface of the housing groove extends in a direction normal to the supporting surface, the supporting surface extending in an arcuate manner.

5. The fluid pressure rotating machine according to claim 1, wherein:

the bush is fixed to the casing via a locking member engaged with a tip of the bush.

* * * * *